US006453980B1

(12) United States Patent
Williams

(10) Patent No.: US 6,453,980 B1
(45) Date of Patent: Sep. 24, 2002

(54) METHOD FOR VERTICAL DIE CASTING OF A ROTOR

(75) Inventor: Timothy Omar Williams, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/475,595

(22) Filed: Dec. 30, 1999

(51) Int. Cl.[7] ..... B22D 33/04
(52) U.S. Cl. ..... 164/137; 164/340
(58) Field of Search ..... 164/98, 91, 94, 164/100, 108, 109, 112, 120, 131, 132, 312, 340, 133, 137, 335, 337, 113; 310/42, 211

(56) References Cited

U.S. PATENT DOCUMENTS 4,429,245 A 1/1984 Iler et al.
4,614,225 A 9/1986 Ernst et al.
4,760,300 A * 7/1988 Yoshida et al. ..... 310/211
4,886,106 A * 12/1989 Bennett ..... 164/70.1
5,067,550 A * 11/1991 Maekawa et al. ..... 164/120
5,332,026 A * 7/1994 Thieman et al. ..... 164/493
5,538,067 A * 7/1996 Nakamura et al. ..... 164/112
5,887,643 A 3/1999 Nakamura et al.
5,937,508 A * 8/1999 Shiga ..... 29/598
5,937,930 A * 8/1999 Nakamura et al. ..... 164/112
6,147,423 A 11/2000 Byrd

* cited by examiner

*Primary Examiner*—M. Alexandra Elve
*Assistant Examiner*—Kevin P. Kerns
(74) *Attorney, Agent, or Firm*—Karl Vick, Esq.; Damian Wasserbauer, Esq.; Armstrong Teasdale LLP

(57) ABSTRACT

A gating system for vertical die casting of a squirrel cage rotor includes an upper end ring cavity, a lower end ring cavity, and a plurality of passages in fluid communication with the upper and lower end ring cavities for forming rotor bars. A gate is radially distanced from the passages, and molten metal is injected into the lower end ring cavity and fills the lower end cavity before filling the passages. The passages are therefore filled at approximately the same time and rate until the passages are full and the upper end ring cavity fills with molten metal.

18 Claims, 2 Drawing Sheets

METHOD FOR VERTICAL DIE CASTING OF A ROTOR

BACKGROUND OF THE INVENTION

This invention relates generally to electric motors, and more particularly, to methods for die casting squirrel cage rotors for electric induction motors.

At least one type of rotor used in electric induction motors includes a rotor core and a plurality of die cast metal rotor bars integrally extending within slots in the rotor core between metal end rings. When electrical windings of a stator are energized, a voltage is induced in the rotor bars, which creates a magnetic field and causes the rotor core to rotate. A shaft is attached to the rotor core and coupled to drive components for driving transmission thereof. The bars are often skewed relative to the end rings to facilitate rotation of the rotor in a predetermined direction and to generate a pre-selected starting torque of the motor. Because of the shape of the metal bars and end rings, these types of rotors are often referred to as "squirrel cage" rotors.

The performance of induction motors including squirrel cage rotors is closely related to the integrity of the bars and the end rings and the connections between the bars and the end rings. For example, if molten metal freezes prematurely during die casting of the squirrel cage, an air gap between one or more of the bars and the end rings may be created. Thus, an "open bar" or an open circuit is created by the gap and the electrical performance of the rotor is impaired. As another example, a "cold shut" bar may result from thin layers of solidified metal, oxides and debris at a leading edge of a flowing molten metal front. When two such metal fronts meet, such as when a bar fills with molten metal simultaneously from both end rings during die casting, the two fronts may incompletely fuse, which increases electrical resistance of a bar and degrades electrical performance of the rotor. Both open bars and cold shut bars are problematic with conventional die casting techniques.

Accordingly, it would be desirable to provide a die cast method for forming squirrel cage induction rotors that reduces occurrences of open bars and decreases electrical resistance of the squirrel cage by inhibiting formation of cold shut bars.

BRIEF SUMMARY OF THE INVENTION

In an exemplary embodiment of the invention, a gating system for vertical die casting of a squirrel cage rotor includes an upper end ring cavity, a lower end ring cavity, and a plurality of passages in fluid communication with the end ring cavities for forming rotor bars. A rotor core including a plurality of rotor bar slots is positioned within the gating system so that the rotor slots extend between the upper and lower cavities and form the passages in fluid communication with the upper and lower end ring cavities.

At least one gate is located a radial distance from the passages so that molten metal may be injected into the gating system lower end ring cavity. Because the gate is located a radial distance from, or separated from, the passages, the lower end ring cavity fills with molten metal before the molten metal fills the passages. As molten metal is continued to be injected, each of the plurality of passages, i.e., the rotor core slots, are filled with molten metal at approximately the same time and at approximately the same rate until the passages are full and the upper end ring cavity fills with molten metal.

Open bars are therefore avoided because molten metal reaches the upper end ring cavity through each of the passages at approximately the same time. Therefore, freezing of the molten metal in any one of the passages is unlikely. In addition, formation of cold shut bars is avoided because molten metal fronts flow through each of the bars in only one direction from the lower end ring cavity toward the upper end ring cavity. Rather than meeting within a reduced cross sectional area of the rotor bar passages, molten metal fronts meet in the relative large cross sectional area of the upper end ring cavity where fusing of the metal fronts is much less of a concern. Thus, electrical resistance of the bars is decreased due to the absence of cold shut bars, which enhances electrical performance of the rotor.

DETAILED DESCRIPTION OF THE INVENTION

Figure 1:
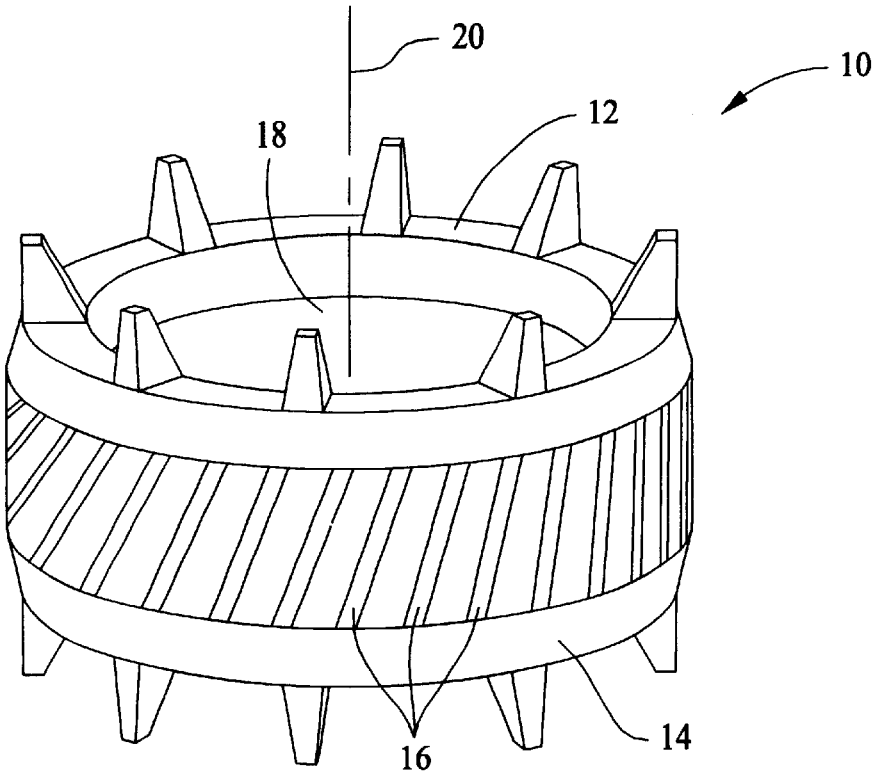
FIG. 1 (Prior Art)
FIG. 1 is a perspective view of a known squirrel cage rotor.

FIG. 1 is a perspective view of a known squirrel cage rotor 10 including an upper end ring 12, a lower end ring 14, and a plurality of rotor bars 16 extending therebetween and around a rotor core 18. End rings 12, 14 and rotor bars 16 are fabricated from die cast metal, and rotor core 18 is fabricated from known ferromagnetic materials using known techniques, including, but not limited to, a plurality of rotor laminations (not shown) bonded together. Rotor bars 16 are skewed, or inclined, relative to a longitudinal axis 20 of rotor 10 to provide motor starting torque and ensure that rotor 10 rotates in a predetermined direction when installed in a stator (not shown). When electrical windings (not shown) in the stator are energized, a voltage is induced across bars 16 from upper end ring 12 to lower end ring 14, or vice versa. The induced voltage creates a magnetic field which causes rotor 10 to rotate. Imperfections in rotor bars 16 can disturb the magnetic field and compromise the performance of rotor 10.

Figure 2:
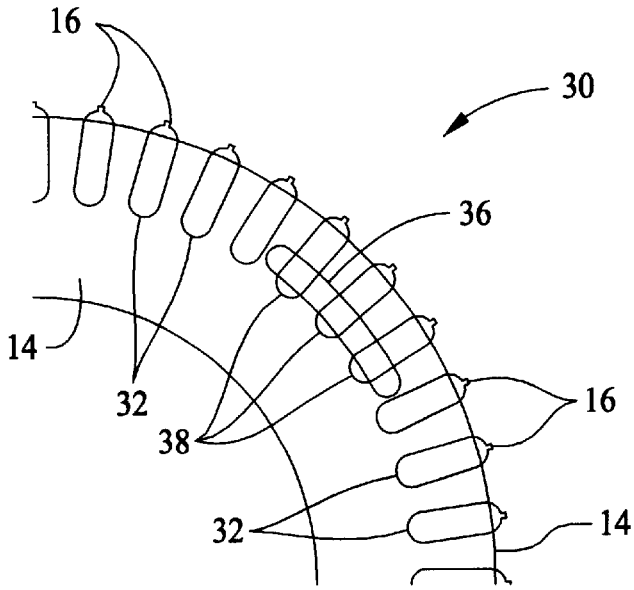
FIG. 2 (Prior Art)
FIG. 2 is a partial schematic view of a known gating system for vertical die casting of the rotor shown in FIG. 1.

FIG. 2 is a partial schematic bottom view of a known gating system 30 for vertical die casting of rotor 10. Rotor core 18 (shown in FIG. 1) includes a plurality of slots 32 for forming rotor bars 16, and molten metal is injected into a molding shell (not shown in FIG. 2) from below rotor core 18 through a gate 36 positioned directly below lower end ring 14 and a portion of rotor slots 32, such as slots 38. Consequently, as molten metal is injected into the molding shell, slots 38 tend to fill before slots 32 located a distance from gate 36. When slots 38 fill completely, molten metal at an opposite end (not shown in FIG. 2) of rotor core 18, i.e., the top end of rotor core 18, flows back down through slots 32 distanced from gate 36, which tends to produce cold shut bars from flowing molten metal fronts (not shown) incompletely fusing together upon meeting one another in a relatively small cross sectional area of rotor slots 32. In addition, heat loss of the molten metal increases as the distance the molten metal travels around rotor core 18 increases during die casting. Thus, molten metal traveling up and down multiple slots 32, 38 presents a possibility of open bars from molten metal freezing or solidifying within rotor slots 32 before fully forming a rotor bar 16, thereby creating air gaps and open circuits in bars 16.

Figure 3:
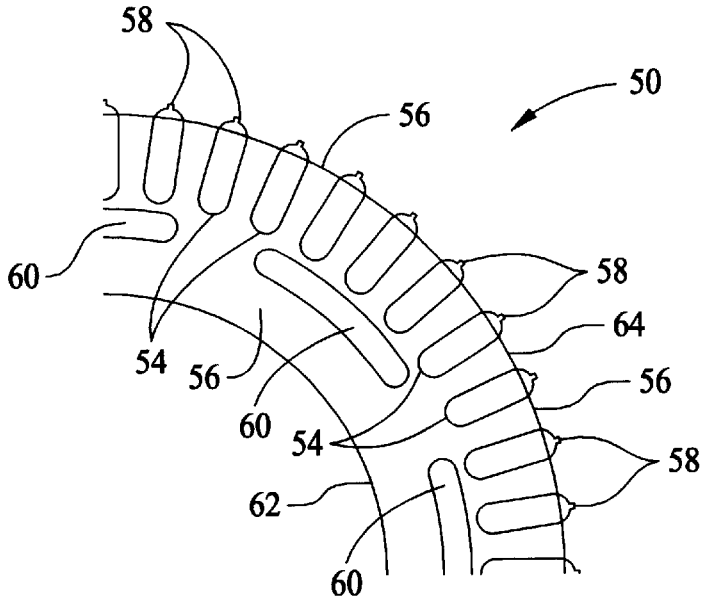
FIG. 3 is a partial schematic view of an exemplary embodiment of a gating system according to the present invention.

FIG. 3 is a partial schematic bottom view of an exemplary embodiment of a gating system 50 that avoids formation of open bars and cold shut bars during vertical die casting of a squirrel cage rotor. A rotor core (not shown in FIG. 2) includes a plurality of slots 54 for forming rotor bars 58, and molten metal is injected into a molding shell (not shown in FIG. 3) below a lower end ring 56 below the rotor core through a plurality of gates 60 laterally distanced from each of rotor slots 54, i.e., not vertically aligned with rotor slots 54. While. the exemplary embodiment illustrated in FIG. 4 employs multiple arcuate gates 60 positioned radially inward of rotor-slots 54, it is contemplated that one or more gates of a variety of shapes could be used in alternative embodiments without departing from the scope of the present invention.

It is further contemplated that in alternative embodiments a gating pad is used to inject molten metal into the molding shell at a distance from rotor bar slots 54. For example, in a rotor including rotor bars extending from an end ring inner edge 62 to end ring outer edge 64, or substantially between inner and outer edges 62, 64 so that locating gate 60 between the end ring inner and outer edges 62, 64 is impractical, a gate pad (not shown in FIG. 3), i.e., a local extension of end ring inner edge 62, may be employed to distance the gate from the rotor bar slots to obstruct a molten metal injection path (not shown in FIG. 3) with the rotor core, as described below, to achieve the benefits of the present invention.

Figure 4:
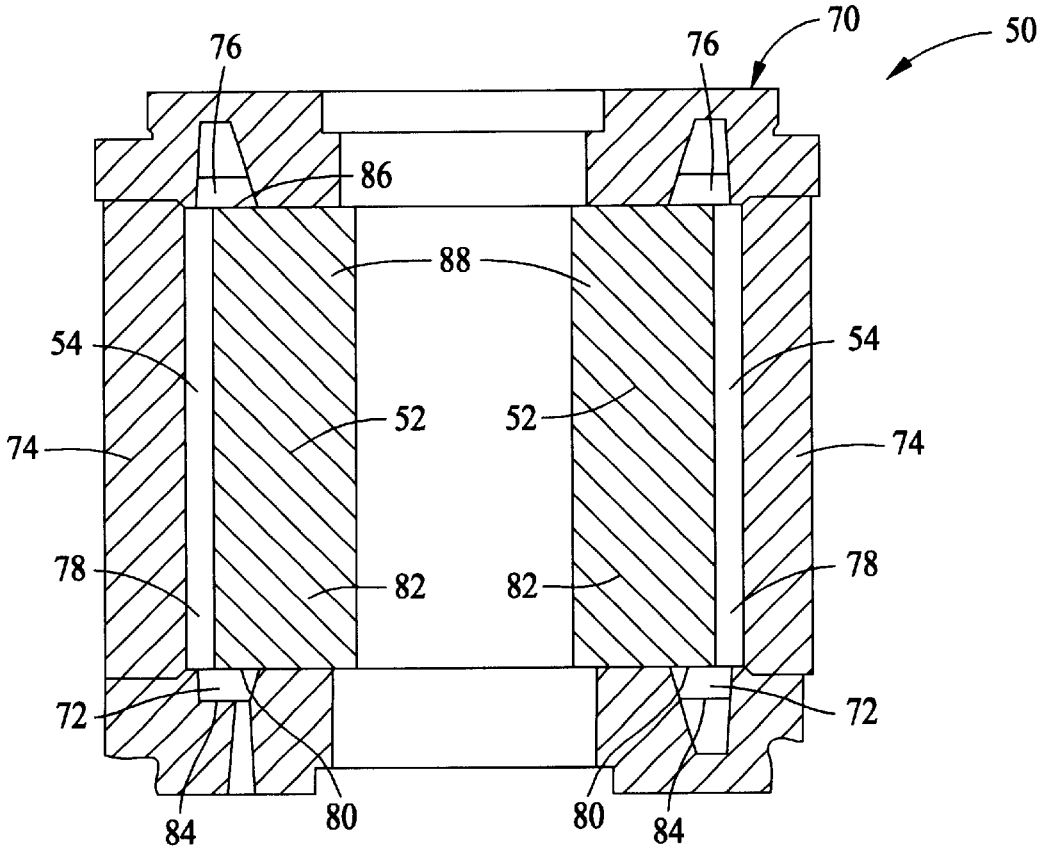
FIG. 4 is a cross sectional schematic of the gating system shown in FIG. 4.

FIG. 4 is a cross sectional schematic of gating system 50 including a molding shell 70 fabricated from known materials according to known methods and forming a lower end ring cavity 72, an enclosure member 74 and an upper end ring cavity 76. When rotor core 52 is positioned within molding shell 70 according to known techniques, rotor slots 54 formed in rotor core 52 and enclosure member 74 form molten metal passages 78 extending between upper and lower-end ring cavities 76, 72 respectively. Lower end ring cavity 72 includes an upper edge 80 formed by a lower end 82 of rotor core 52, a lower edge 84 formed by molding shell 70, and gate 60 accessible to lower edge 84 for injecting molten metal into gating system 50 once rotor core 52 is properly positioned within molding shell 70. Passages 78 extend vertically upward from lower end ring cavity upper edge 80 to an upper end ring cavity lower edge 86 formed by a top end 88 of rotor core 52.

In an alternative embodiment, rotor slots are embedded, or enclosed, in rotor core 52 to form self contained passages for forming rotor bars, in which molding shell enclosure member 74 is unnecessary to form rotor bars once rotor core is properly positioned between upper and lower end ring cavities, 76, 72, respectively.

When molten metal is injected into gating system 50 through gate 60, molten metal is prevented from directly flowing into any of rotor slots 54 or passages 78 but rather is redirected by lower end ring cavity upper edge 80, i.e., by rotor core 52, and consequently distributed in lower end ring cavity 72 before filling rotor passages 78. Thus, molten metal flows into passages 78 only when lower end ring cavity 72 is substantially full, at which time the flowing molten metal flows upwardly into each passage 78 at approximately the same time and at approximately the same rate to form rotor bars 58 (shown in FIG. 3). Because of the concurrent filling of passages 78 at approximately an equal rate, each of passages 78 becomes full at approximately the same time, and molten metal rises into upper end ring cavity 76.

Therefore, gating system 50 facilitates a continuous upward formation of rotor bars 58 (shown in FIG. 3) which avoids formation of cold shut bars from molten metal flowing through passages 78 in opposite directions as is known to occur with conventional die casting methods. Also, a distance traveled by molten metal is minimized using gating system 50, thereby minimizing occurrences of formation of open bars. While one gate 60 is illustrated in FIG. 4, the benefits of the invention are maximized by simultaneously injecting molten metal through a plurality of gates.

When upper end ring cavity 76 is filled with molten metal, pressure is maintained within gating system by a plunger (not shown) used to inject the molten metal through gate 60 until the molten metal freezes or solidifies as it is cooled by conventional methods. Once the metal has cooled, a squirrel cage rotor, such as rotor 10 (shown in FIG. 1) is removed from molding shell 70. Gate 60 is mechanically broken as the molding shell is opened and the cast rotor is removed.

In alternative embodiments, the above described method may be employed to die cast squirrel cage rotors with straight rotor bars, i.e., not skewed, and various other configurations of squirrel cage motors beyond those specifically illustrated or described. Also, while the method has been described in the context of vertical die casting, i.e., molten metal is injected into molding shell 70 (shown in FIG. 4) in a vertical direction parallel to rotor longitudinal axis 20 (shown in FIG. 1), it is contemplated that molten metal may be injected into molding shell 70 in a horizontal direction or other non-vertical direction without departing from the scope of the present invention.

While the invention has been described in terms of various specific embodiments, those skilled in the art will recognize that the invention can be practiced with modification within the spirit and scope of the claims.

What is claimed is:

1. A method for vertical die casting of a squirrel cage rotor for an induction electric motor using a gating system, the rotor including a rotor core having a plurality of slots, the gating system including at least one end ring cavity, a plurality of passages in fluid communication with the end ring cavity for forming rotor bars, at least one gate in fluid communication with the end ring cavity, and the end ring cavity having an upper edge, said method comprising the steps of:

positioning the rotor core inside the gating system; and filling the gating system with molten metal through the gate such that the end ring cavity upper edge facilitates preventing molten metal from directly entering the plurality of passages such that the end ring cavity is substantially filled prior to introducing molten metal into each of the plurality of passages at approximately the same rate.

2. A method in accordance with claim 1 wherein the gating system includes an upper end ring cavity and a lower end ring cavity, each of the upper and lower end ring cavities in fluid communication with the plurality of passages, said step of filling the gating system comprising the step of introducing molten metal into the lower end ring cavity through the gate, thereby filling the lower end ring cavity before filling the passages.

3. A method in accordance with claim 2 wherein said gating system comprises a plurality of gates in fluid communication with the lower end ring cavity, said step of introducing molten metal comprises the step of introducing molten metal simultaneously through each of the gates.

4. A method in accordance with claim 1 further comprising the step of positioning the rotor core within the gating system so that the step of filling the gating system comprises the step of introducing molten metal into the end ring cavity so that molten metal contacts the rotor core before entering any of the plurality of passages.

5. A method in accordance with claim 4 wherein the end ring cavity is substantially horizontal and includes an upper edge and a lower edge, the plurality of passages extending vertically from the end ring cavity upper edge, said step of filling the end ring cavity comprises the step of injecting molten metal into the end ring cavity from the end ring cavity lower edge.

6. A method in accordance with claim 1 wherein the gating system includes an upper end ring cavity positioned above the plurality of passages and a lower end ring cavity positioned below the plurality of passages, said step of filling the gating system comprises the step of injecting molten metal into the lower end ring cavity until the upper end ring cavity is full of molten metal.

7. A method in accordance with claim 6 wherein said step of injecting molten metal comprises injecting molten metal into the lower end ring cavity such that the passages fill at approximately the same time.

8. A method in accordance with claim 6 further comprising the step of cooling the molten metal.

9. A method in accordance with claim 8 further comprising the step of removing the rotor from the gating system.

10. A method for vertical die casting of a squirrel cage rotor for an induction electric motor using a gating system, the rotor including a rotor core having a plurality of slots on an exterior surface thereof, the gating system including at least one end ring cavity, a plurality of passages in fluid communication with the end ring cavity for forming rotor bars, at least one gate in fluid communication with the end ring cavity, and the end ring cavity having an upper edge, said method comprising the steps of:

positioning the rotor core inside the gating system so that the gate is laterally distanced from each of the plurality of passages; and filling the gating system with molten metal through the gate such that the end ring cavity upper edge facilitates preventing molten metal from directly entering the plurality of passages.

11. A method in accordance with claim 10 wherein the gating system includes an upper end ring cavity and a lower end ring cavity, each of the upper and lower end ring cavities in fluid communication with the plurality of passages, said step of filling the gating system comprising the step of introducing molten metal into the lower end ring cavity through the gate, thereby filling the lower end ring before filling the passages.

12. A method in accordance with claim 11 wherein said gating system comprises a plurality of gates in fluid communication with the lower end ring cavity, each of the gates laterally distanced from the plurality of passages, said step of introducing molten metal comprises the step of introducing molten metal simultaneously through each of the gates.

13. A method in accordance with claim 10 further comprising the step of positioning the rotor core within the gating system so that molten metal contacts the rotor core before entering any of the plurality of passages.

14. A method in accordance with claim 13 wherein the end ring cavity is substantially horizontal and includes an upper edge and a lower edge, the plurality of passages extending vertically from the end ring cavity upper edge, said step of filling the end ring cavity comprises the step of injecting molten metal into the end ring cavity from the end ring cavity lower edge.

15. A method in accordance with claim 10 wherein the gating system includes an upper end ring cavity positioned above the plurality of passages and a lower end ring cavity positioned below the plurality of passages, said step of filling the gating system comprises the step of injecting molten metal into the lower end ring cavity until the upper end ring cavity is full of molten metal.

16. A method in accordance with claim 15 wherein said step of injecting molten metal comprises injecting molten metal into the lower end ring cavity such that the passages fill at approximately the same time.

17. A method in accordance with claim 15 further comprising the step of cooling the molten metal.

18. A method in accordance with claim 17 further comprising the step of removing the rotor from the gating system.

* * * * *